US009476219B2

(12) United States Patent
Skolnekovich

(10) Patent No.: US 9,476,219 B2
(45) Date of Patent: Oct. 25, 2016

(54) TEMPORARY SHELTER

(71) Applicant: SadiShelter Homekits & Systems, Inc., Colorado Springs, CO (US)

(72) Inventor: Darla K. Skolnekovich, Colorado Springs, CO (US)

(73) Assignee: SadieShelter Homekits & Systems, Inc., Colorado Springs, CO (US)

( * ) Notice: Subject to any disclaimer, the term of this patent is extended or adjusted under 35 U.S.C. 154(b) by 0 days.

(21) Appl. No.: 14/814,074

(22) Filed: Jul. 30, 2015

(65) Prior Publication Data

US 2016/0060895 A1 Mar. 3, 2016

Related U.S. Application Data

(60) Provisional application No. 62/033,212, filed on Aug. 5, 2014.

(51) Int. Cl.
*E04B 1/346* (2006.01)
*E04H 14/00* (2006.01)
(Continued)

(52) U.S. Cl.
CPC ..... *E04H 14/00* (2013.01); *E04B 7/028* (2013.01); *E04H 1/1205* (2013.01); *E04B 1/34315* (2013.01); *E04B 2/84* (2013.01); *E04B 2001/0076* (2013.01); *E04B 2001/0092* (2013.01)

(58) Field of Classification Search
CPC . E04H 14/00; E04H 1/1205; E04B 1/34315; E04B 2/84; E04B 2001/0092; E04B 2001/0076
USPC ..... 52/281, 71, 220.2
See application file for complete search history.

(56) References Cited

U.S. PATENT DOCUMENTS 1,198,524 A * 9/1916 Cunliffe ..... B65D 7/26 119/499
2,184,714 A * 12/1939 Freeman ..... E04B 2/14 52/220.2

(Continued)

FOREIGN PATENT DOCUMENTS

WO WO/94/19558 9/1994

OTHER PUBLICATIONS

'SadieShetler HomeKits and Systems, Inc.' by Cause. Nov. 21, 2011 [Online],[retrieved on Sep. 28, 2015]. Retrieved from the Internet: <https://wvvw.facebook.com/SadieSheter-HomeKits-and-Systems-Inc-180873705335713/timeline/>, entire document.

(Continued)

*Primary Examiner* — Basil Katcheves
*Assistant Examiner* — Joshua Ihezie
(74) *Attorney, Agent, or Firm* — Martensen IP

(57) ABSTRACT

A portable shelter includes a plurality of planar wall sections configured to form an enclosure constructed from corrugated fiberboard material. Each wall section includes an inner panel, an outer panel, and a fillable region interposed between that can be filled with insulating material. Each wall section includes a set of extensions on a first edge and a complementary set of extensions on the other edge. The extensions of one wall section are configured join with the extensions from another wall section to form a joint. A roof is created by stacking a plurality of roof sections formed from joining the non-parallel sides of a plurality of trapezoidal roof panels.

22 Claims, 16 Drawing Sheets

(51) Int. Cl.

| | |
|---|---|
| ***E04H 1/12*** | (2006.01) |
| ***E04B 7/02*** | (2006.01) |
| *E04B 1/00* | (2006.01) |
| *E04B 1/343* | (2006.01) |
| *E04B 2/84* | (2006.01) |

(56) References Cited

U.S. PATENT DOCUMENTS 3,996,706 A * 12/1976 Bomgaars ..... E04B 2/7416 52/71
4,546,583 A * 10/1985 Hussar ..... E04B 1/04 52/236.1
4,640,061 A * 2/1987 Trumley ..... E04B 1/34321 52/656.1
4,672,779 A * 6/1987 Boyd ..... E04H 15/001 52/71
5,083,410 A 1/1992 Watson
5,107,652 A * 4/1992 Sosa ..... E02D 29/025 160/135
5,168,678 A * 12/1992 Scott, Jr. ..... A01G 1/08 47/33
5,319,905 A * 6/1994 Szirtes ..... B64G 1/443 136/245
5,371,982 A * 12/1994 Douglas ..... E01F 7/00 52/243.1
5,642,594 A * 7/1997 Sucre F ..... E04C 2/386 52/270
5,750,235 A * 5/1998 Yoshimasa ..... B31F 1/0009 428/134
5,920,936 A * 7/1999 Wiedeck ..... E01D 15/124 14/13
6,099,092 A 8/2000 Uffner et al.
6,145,257 A * 11/2000 Cappuccio ..... E04B 2/8647 52/220.2
6,250,021 B1 * 6/2001 Ferrara, Jr. ..... E04B 1/344 446/423
6,446,398 B2 * 9/2002 Weir ..... E04H 17/168 160/135
6,675,538 B2 * 1/2004 Candio ..... A63J 11/00 273/110
7,234,275 B1 * 6/2007 Haggy ..... E01F 13/022 160/135
8,209,916 B2 * 7/2012 Herron ..... E04B 2/12 220/4.28
8,381,454 B1 2/2013 Robinson
8,557,121 B1 * 10/2013 Mendes ..... E02B 15/101 210/242.4
9,097,032 B1 * 8/2015 Al-Saffar ..... E04H 1/1205
2008/0216426 A1 * 9/2008 Bunker ..... E04B 1/34315 52/285.3
2008/0282623 A1 * 11/2008 Powell ..... E04B 1/04 52/71
2009/0313925 A1 * 12/2009 Lyons ..... E04H 1/1205 52/274
2010/0319285 A1 * 12/2010 Jewett ..... E04B 1/161 52/309.4
2011/0209735 A1 9/2011 Rowan
2013/0067846 A1 * 3/2013 Kvols ..... E04H 1/1205 52/586.1

OTHER PUBLICATIONS

How to Build Playhouse With Spare Cardboard Boxes by Croft. Sep. 2, 2013 [Online], [retrieved on Oct. 7, 2015]. Retrieved from the internet:<https://web.archive.org/web/20131107142433/http://www.mykidsadventures.com/build-cardboard-playhouse/>, entire document.

Notification of Transmittal of the International Search Report and the Written Opinion of the International Searching Authority, or the Declaration; PCT Application No. PCT/US2015/043371; Filed Aug. 3, 2015.

* cited by examiner

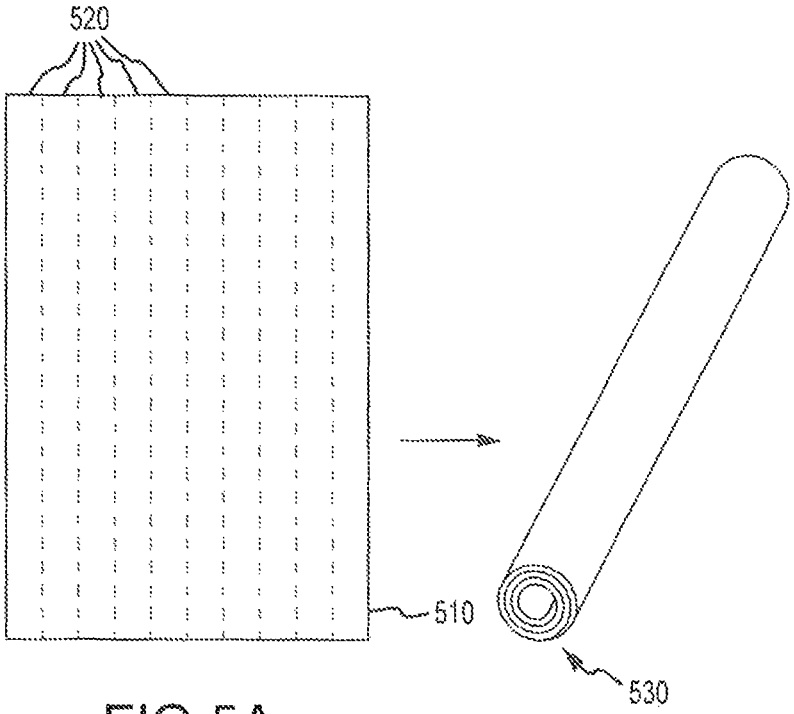
FIG.5A
FIG.5B
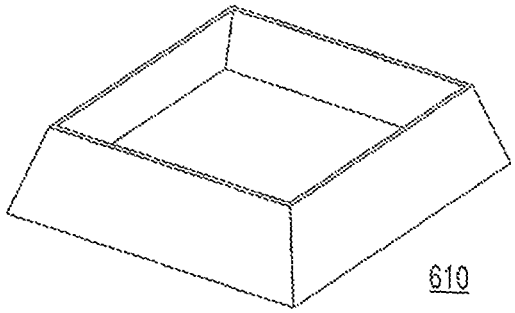
FIG.6

TEMPORARY SHELTER

BACKGROUND OF THE INVENTION

1. Field of the Invention

Embodiments of the present invention relate, in general, to temporary structures, and more particularly to temporary structures constructed from corrugated fiberboard.

2. Relevant Background

A political or environmental crisis can be devastating to populations and families, sometimes forcing people from their homes and property. One way to minimize human damage and provide safety and comfort for victims is to provide them a temporary shelter or structure.

A shelter can range from a fabric tent to a transitional building that may last years as the occupants find or construct permanent housing. In an area that has suffered a natural disaster, lack of shelter can have disastrous consequences. In many instances, the need for shelter can last weeks, months, or even years. Conventional portable shelter structures, such as collapsible tents or canopies, usually consist of fabric supported by a rigid frame structure. The rigid frame structure may be formed from multiple, interconnected metallic or plastic tubes. Each time such a portable structure is used, the rigid frame and fabric structures must be assembled and combined together. In order to move or store the structure, the frame must be disassembled and the fabric structure folded or collapsed to a compact size. Portable shelters of this type are versatile, but the assembly process for such a structure can be difficult to perform, offering limited durability. Accordingly, these "tent-like" types of structures offer some immediate shelter from exposure to various environmental conditions but offer little once the immediate threat or emergency has passed. Moreover, canvas and poly-composite "tent" structures are often chemically treated. These toxins can potentially leach into the interior environment threatening the wellbeing of the occupants. And these types of structures offer no security for its inhabitants from assault.

Temporary hard-shell structures are more durable (even in extreme weather conditions) and offer a more substantial living space. There are various designs that provide environments that can be sustained for months and even years. These designs, however, go above and beyond the standard stock emergency shelters in providing more efficient, affordable, and comfortable living quarters. While clearly more durable and reliable than emergency shelters, temporary shelters are generally more complex to build, require additional resources such as electricity and components/tools which may or may not be available, are more expensive, and require additional time and skill to construct. In some instances, a temporary structure may last two to three years but require four to six weeks to construct.

Therefore, there is a need for a temporary structure that is both versatile and easy to construct while also providing a durable, securable, living environment to enable its inhabitants to recover and transition back to permanent housing. Such a structure must be durable, securable, easy to construct, and cost-effective to produce. These and other deficiencies of the prior art are addressed by one or more embodiments of the present invention.

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

A portable shelter is hereafter described by way of example. In one embodiment of the present invention the temporary shelter includes a plurality of planar wall sections configured to form an enclosure constructed from corrugated fiberboard material wherein each planar wall section includes an inner panel, an outer panel, and a fillable region interposed between the inner panel and the other panel. Each wall section includes a top edge, a bottom edge, a first side edge, and a second side edge wherein the first side edge includes a set of extensions and the second side edge includes a set of complementary extensions. The set of extensions on the first side edge are configured to receive the complementary set of extensions from another wall section forming a wall joint.

The invention also includes a plurality of linking corrugated fiberboard panels wherein each linking corrugated fiberboard panel includes several parallel scores such that each linking corrugated fiberboard panel can be rolled to form a dowel. Each wall joint is configured to accept one of the dowels linking the set of extensions in one wall section to the complementary set of extensions in another wall section The roof of the structure is formed from one or more roof sections positioned on the enclosure. Each roof sections is formed from a plurality of trapezoidal roof panels constructed from corrugated fiberboard material wherein non-parallel sides of the plurality of trapezoidal roof panels are joined forming a seam to create the roof section.

Other aspects of the present invention are that each extension associated with each wall section is a substantially a 'C' channel coupling the inner panel to the outer panel and that the inner and otter panels are constructed from corrugated fiberboard. Each of these panels and includes a set of inner panel flutes such that the inner panel flutes and the outer panel flutes are oriented so as to be perpendicular to each other.

The present invention also includes planar wall section that have two or more internal support channels, each configured to accept one of the dowels. The dowels reinforce the wall section and increase rigidity. A joint cap can be affixed to an exterior portion of each wall section forming the joint to bridge the joint and protect the extensions from the exterior environment.

The roof can be formed from a plurality of roof sections wherein between each roof section a ventilation space is created. A roof peak cap completes the roof. The one or more roof sections overlap such that a longer side of each trapezoidal roof panel of an upper roof section is associated with a shorter side of each trapezoidal roof panel of a lower roof section. More over, a plurality of roof ridge can be affixed to an exterior portion of each trapezoidal roof panel covering each seam.

At least one of the wall sections includes an aperture (opening) suitable to enable ingress and egress to the temporary shelter. A door is configured to fit within the aperture. The door includes a securing mechanism configured to secure the door to the wall section from either within or outside the temporary shelter.

According to another embodiment of the present invention a temporary shelter is formed from coupling together a plurality of wall sections wherein each planar wall section includes a fillable region interposed between an inner panel and an outer panel constructed from corrugated fiberboard material wherein each planer wall section includes a top edge, a bottom edge, a first side edge, and a second side edge.

The shelter includes a plurality of wall section joints wherein each wall section joint includes a set of knuckles associated with the first side edge of a wall section and a set of complementary knuckles associated with a second side edge of another wall section. The set of knuckles associated with the first side edge is configured to receive the set of complementary knuckles associated with the second side edge of the other wall section forming a barrel. A dowel formed from corrugated fiberboard is inserted into the barrel of each wall section joint coupling together the plurality of wall sections to form the enclosure.

A roof covering the enclosure completes the shelter whereby the roof is formed by positioning two or more roof sections on top of the enclosure by overlapping each of the roof sections such that a longer side of an upper trapezoidal roof panel of an upper roof section is associated with a shorter side of a lower trapezoidal roof panel of a lower roof section.

Another aspect of the present invention is that each roof section is constructed from a plurality of similarly sized corrugated fiberboard trapezoidal roof panels by joining non-parallel sides of the roof panels and wherein each of the roof sections is formed from corrugated fiberboard trapezoidal roof panels of different sizes. The corrugated fiberboard material used includes flutes, and wherein flutes associated with the inner panel are perpendicular to flutes associated with the outer panel for added strength.

Each wall section, according to one embodiment, includes a plurality of channels parallel with the wall section joints within the fillable region, and wherein each channel is configured to accept a dowel to increase wall section strength and rigidity. Additionally each wall section includes a floor flashing that can join with a floor section inserted into the enclosure and overlapping the floor flashing.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter. Reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein:

FIGS. 5A and 5B shows respectively, a flat sheet of corrugated fiberboard scored so as to be rolled into a dowel for use in connecting and supporting the wall sections and a rolled depiction of the flat sheet of corrugated fiberboard rolled into a dowel, according to one embodiment of the present invention;

FIG. 6 is a perspective view of an exemplary roof section according to one embodiment of the present invention;

Figure 1:
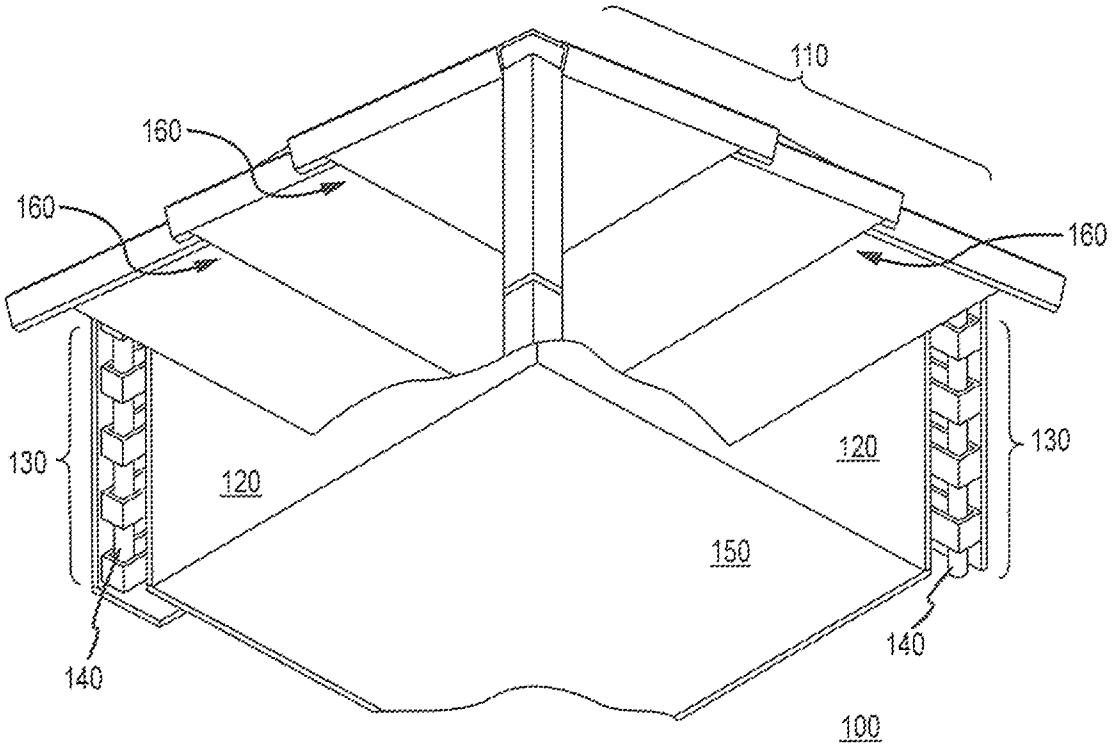
FIG. 1 shows a cutaway perspective view of a temporary structure according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

A temporary structure constructed from corrugated fiberboard is hereafter disclosed by way of example. One or more embodiments of the present invention provide a double walled structure constructed almost entirely of corrugated fiberboard. Each wall section connects with another wall section by joining a series of extensions using a dowel crafted from fiberboard. An enclosure formed by joining a series of wall sections is coupled to a series of overlapping roof sections. Each roof section is crafted from trapezoidal shaped pieces of corrugated fiberboard that, when coupled using a bracing extension, form a tapered ring or roof section. Using smaller trapezoidal pieces a smaller roof section can be formed that, when associated with roof sections formed from larger trapezoidal sections, overlap to form a continuous roof.

The temporary shelter of the present invention is constructed of highly durable, water and fire resistant, cost-effective corrugated fiberboard. While providing excellent strength-to-weight capability, corrugated fiberboard, as assembled according to the present invention, can create a temporary structure which can be assembled in a single day by a individual of average size, yet survive in a variety of environments for one to two years.

To better understand the various embodiments of the present invention presented below, consider the definitions of the following terms and concepts. Embodiments of the present invention are hereafter described in detail with reference to the accompanying Figures. Although the invention has been described and illustrated with a certain degree of particularity, it is understood that the present disclosure has been made only by way of example and that those skilled in the art can resort to numerous changes in the combination and arrangement of parts without departing from the spirit and scope of the invention.

The following description is provided to assist in a comprehensive understanding of exemplary embodiments of the present invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention are provided for illustration purposes only and not for the purpose of limiting the invention as defined by the appended claims and their equivalents.

By the term "substantially," it is meant that the recited characteristic, parameter, or value need not be achieved exactly, but that deviations or variations, including for example, tolerances, measurement error, measurement accuracy limitations, and other factors known to those of skill in the art, may occur in amounts that do not preclude the effect the characteristic was intended to provide.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an," and "the" are intended to include the plural forms as well, unless the context clearly indicates otherwise. Thus, for example, reference to "a component surface" includes reference to one or more of such surfaces.

As used herein, any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements, but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting," "mounted" on etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper," and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Terminologies such as "Transitional shelter," "Progressive shelter," and "Core shelter" are often used for shelter after disasters and as a result of conflicts. Most terminologies relate to an approach rather than a phase of response, recognizing that post—disaster shelter is often built, upgraded, and maintained by the affected populations themselves.

An Emergency shelter is a short-term shelter that provides life-saving support. This is the most basic shelter support that can be provided immediately after the disaster. A tent is an example of an emergency shelter.

T-Shelters: A term often used to mean either Temporary shelter or Transition Shelter.

Temporary Shelters: A post-disaster household shelter designed as a rapid solution. By prioritizing speed of availability and limiting cost of construction, the lifetime of the shelter may be constrained.

Transitional Shelter: Rapid, post-disaster household shelters made from materials that can be upgraded or re-used in more permanent structures, or that can be relocated from temporary sites to permanent locations. Transitional shelters are designed to facilitate the transition by affected populations to more durable shelters.

Progressive Shelters: Post-disaster rapid household shelters planned and designed to be upgraded later to a more permanent status.

Core Shelters/One Room Shelters: Post-disaster household shelters planned and designed as permanent dwellings, to be part of future permanent housing, allowing and facilitating the future process of extension by the household, following its own means and resources.

These definitions have overlapping applications. For example, emergency shelters/short-term shelters provide life-saving support that can be provided immediately after the disaster. Temporary shelters bridge the gap between an emergency and short-term shelter to that of a transitional shelter. While not designed for reuse or for incorporation into a permanent dwelling, temporary shelters provide a durable alternative to a short-term shelter and the means by which to construct permanent dwellings.

Included in the description are flowcharts depicting examples of the methodology that may be used to construct a temporary shelter consistent with the present invention. In the following description, it will be understood that each block of the flowchart illustrations, and combinations of blocks in the flowchart illustrations, can be implemented by computer program instructions. These computer program instructions may be loaded onto a computer or other programmable apparatus in order to produce a machine such that the instructions that execute on the computer or other programmable apparatus create means for implementing the functions specified in the flowchart block or blocks. These computer program instructions may also be stored in a computer-readable memory that can direct a computer or other programmable apparatus to function in a particular manner such that the instructions stored in the computer-readable memory produce an article of manufacture including instruction means that implement the function specified in the flowchart block or blocks. The computer program instructions may also be loaded onto a computer or other programmable apparatus to cause a series of operational steps to be performed in the computer or on the other programmable apparatus to produce a computer implemented process such that the instructions that execute on the computer or other programmable apparatus provide steps for implementing the functions specified in the flowchart block or blocks.

Accordingly, blocks of the flowchart illustrations support combinations of means for performing the specified functions and combinations of steps for performing the specified functions. It will also be understood that each block of the flowchart illustrations, and combinations of blocks in the flowchart illustrations, can be implemented by special purpose hardware-based computer systems that perform the specified functions or steps, or combinations of special purpose hardware and computer instructions.

FIG. 1 shows a temporary structure 100 constructed, in one embodiment, of corrugated fiberboard. FIG. 1 depicts a cut-away view of a four-sided corrugated fiberboard temporary structure 100. As shown in other figures, and as would be contemplated by one of reasonable skill in the relevant art, the present invention shown in FIG. 1 can be revised to reflect a different walled environment shape such as a pentagon or octagon. The concepts presented herein are not constrained to a simple square or rectangular shape, but rather can embrace a variety of other shapes as needs of the environment demand.

In FIG. 1, the cut-away image shows a substantially square shelter topped with three roof sections 110. Each wall 120 of the walled environment is comprised of two or more panels with a space interposed between the panels. In the case of FIG. 1, the walls include an inner panel and an outer panel encapsulating a single interior wall space. The ends of each wall include a series of extensions or knuckles 130. The knuckles of one wall section interact with knuckles extending from another wall section to form a wall joint. With the knuckles of the two wall sections intermeshed, a vertical dowel 140 is extended through the length of the joint to securely connect the two wall sections. In the same manner, additional wall sections can be connected to form a walled environment. Once the walled environment is complete, a floor 150 can be placed within the walled environment and secured to the flashing. In other embodiments, the walled temporary structure can be placed on a prefabricated floor such as a concrete foundation, wood floor, or similarly prepared surface, with or without the attached floor. Alternatively, the walled environment can be placed directly on the ground without losing any structural integrity.

The walls of the temporary structure of the present invention are, in a preferred embodiment, constructed from corrugated fiberboard, containerboard, or honeycomb stacked board. Containerboard, also referred to as CCM or corrugated case material, is a type of paperboard specially manufactured for the production of corrugated board. The term encompasses both linerboard and corrugating medium (or fluting), the two types of paper that make up corrugated board. Since containerboard is made mainly out of natural, unbleached wood fibers, it is generally brown. However, its shade may vary depending on the type of wood, pulping process, recycling rate, and impurities content. For certain boxes that demand good presentation, white bleached pulp or coating is used on the top ply of the linerboard that goes outside the box.

Corrugated fiberboard is a paper-based material consisting of a fluted corrugated sheet and one or two flat linerboards. It is made on "flute lamination machines" or "corrugators" and is used in the manufacture of shipping containers and corrugated boxes.

Corrugated fiberboard has a higher stiffness (resistance to bending) than flat fiberboard of equal mass, especially parallel to the corrugations. The Theorema Egregium can explain this characteristic. The pleated board is roughly isometric to a flat plane, which has a Gaussian curvature of 0. Since the material is curved in one direction, perpendicular to the pleats, it must remain flat in the direction parallel to the pleats.

Corrugated board is manufactured on large, high-precision machinery lines called corrugators, usually running at about 500 feet per minute (150 m/min) or more. These machines, over time, have become very complex with the objective of avoiding some common problems in corrugated board production, such as warp and wash boarding.

Obviously, the key raw material in corrugating is paper, as different grades for each layer make up the corrugated box. The strength of corrugated fiberboard is substantially related to its ability to resist weather. In most cases, the paperboard components of a corrugated fiberboard are treated with a suitable wet strength resin to make the resulting board resistant to water. Similarly, the paperboard components can also be treated with fire retardant to meet safety requirements and to prolong the durability of the shelter.

In most cases, the outer surface of the corrugated fiberboard is treated with a water resistant coating to enhance strength and durability. According to one embodiment of the present invention, the panels used to construct the wall sections are each treated with a water resistant coating to deter the wall's ability to absorb moisture and thereby reduce the fiberboard's strength. Similarly, the adhesives used to capture the flutes between the paperboard can also be treated to be water and fire resistant.

According to one embodiment of the present invention, each panel of the wall section is constructed for a dual-walled, corrugated fiberboard product that is treated to be water and fire resistant. In other embodiments, triple-walled corrugated fiberboard products can be used to form the wall sections and other aspects of the present invention.

Figure 2:
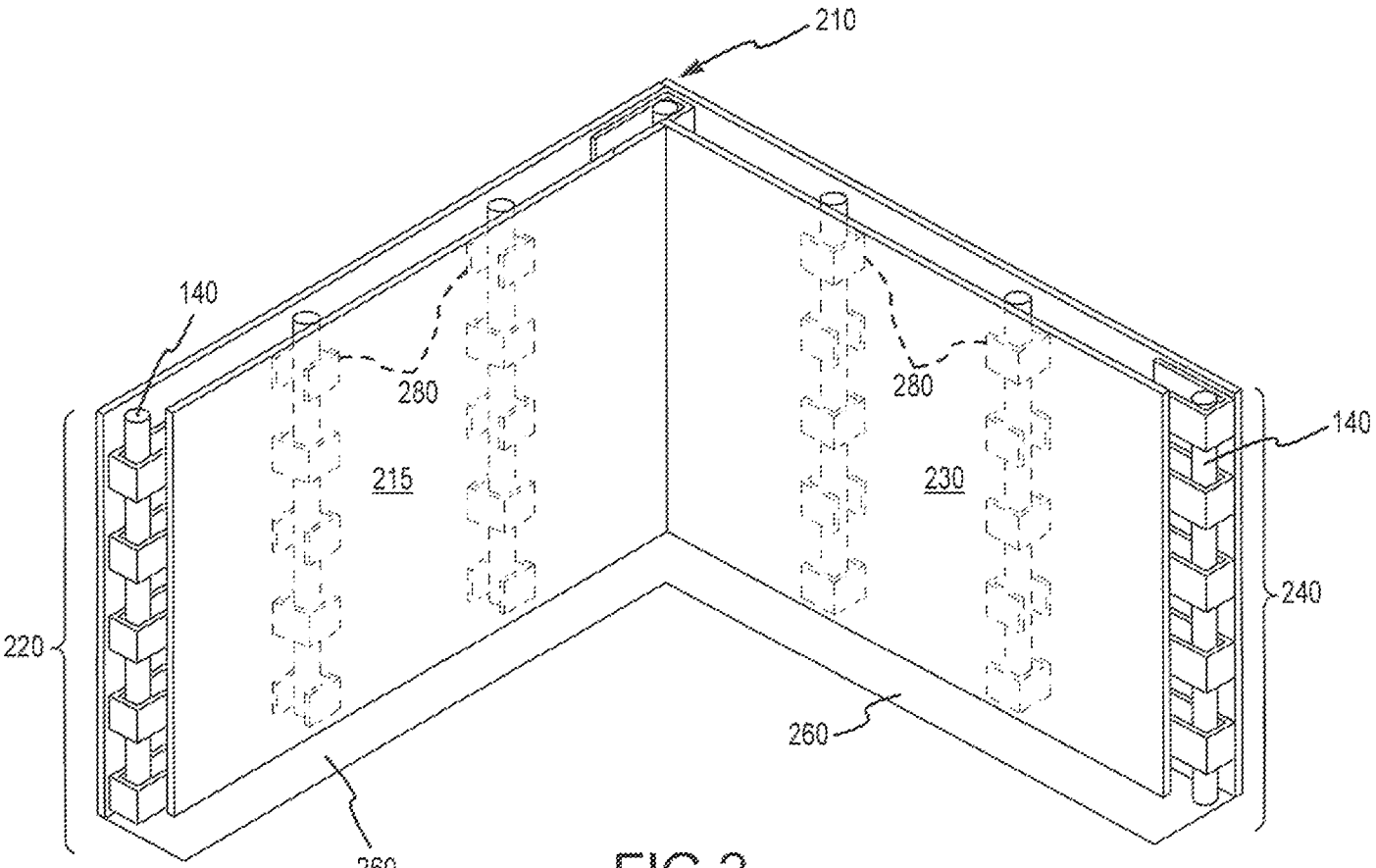
FIG. 2 shows a perspective view of two joined wall sections according to one embodiment of the present invention.

FIG. 2 presents an inner perspective view of two joined wall sections according to one embodiment of the present invention. The view shown in FIG. 2 is of on inner corner within exposed knuckles at each opposing end. Each wall section includes an upper edge, a bottom edge, a first side edge and a second side edge. The wall sections are joined at the wall section joint by a dowel 140 which transverses the interlaced knuckles of the coupled wall sections to secure the joint 210. As shown in FIG. 2, the left most wall section 215 depicts a set of five extensions or knuckles 220 that begin from the bottom and are evenly spaced throughout the edge of the panel. The uppermost portion of the edge remains void of a knuckle and is configured to accept a complementary knuckle from an adjoining wall section forming a barrel.

The right most wall section 230 is, in this embodiment, identical to that of the left most wall section. The exposed edge of the right most panel shows another set of knuckles 240 that are positioned so as to match the gaps present in the exposed knuckles of the left most wall section. In this case, the knuckles 240 of the right most wall section are evenly spaced, beginning from the top of the wall, with the bottom most area void of material. Thus, when combined with a complementary set of knuckles, the respective voids of each are filled and the knuckles become interlaced.

FIG. 2 further depicts a floor flashing 260 associated with the bottom edge which, when combined with a floor insert (not shown) forms a seamless walled environment. The flashings can, alternatively, be secured to the floor insert or with the flashings of overlapping wall sections.

Each wall section also includes two or more additional vertical channels 280 into which a dowel 140 can be inserted. As previously mentioned the walls are constructed using an inner and outer panel of corrugated fiberboard. The space between the panels is supported by the periodic placement of fiberboard supports fashioned to be similar to a channel or letter "C". By alternating the supports along a vertical axis, the channels form a conduit into which a dowel can be placed. The inclusion of the dowel within the channel adds strength and rigidity to the wall section. The combined wall sections shown in FIG. 2 include a vertical dowel joining the left most wall section to the right most wall section at the wall joint. The Figure also depicts two additional dowels in each wall section respectively to add strength and rigidity.

Figure 3:
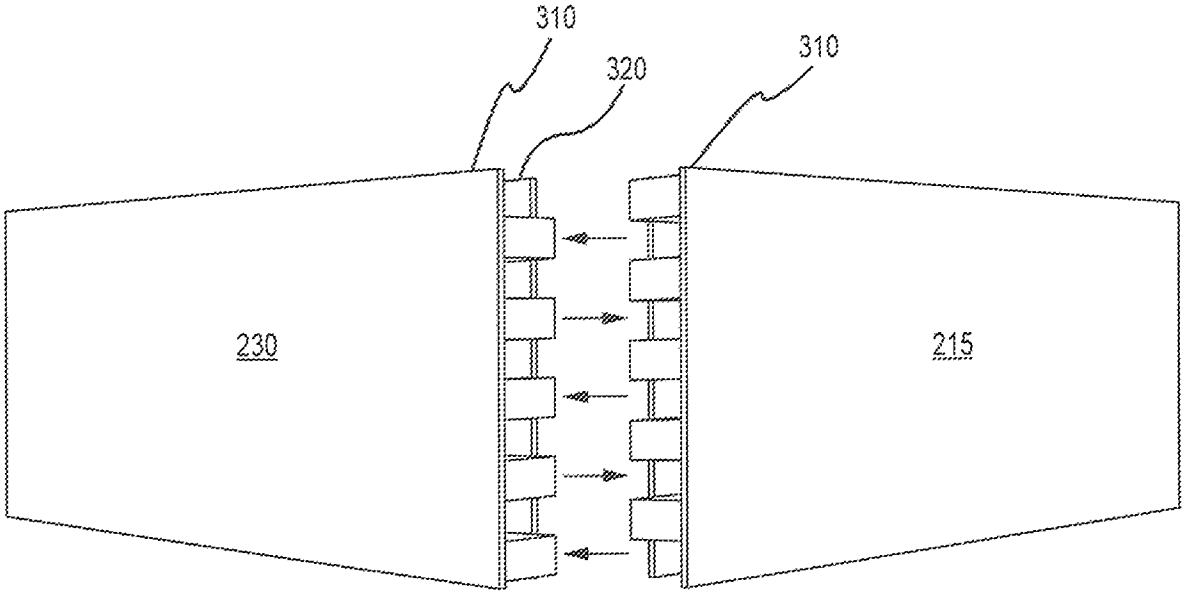
FIG. 3 is a back perspective view of the two joined wall sections shown in FIG. 2.

FIG. 3 shows an outside perspective view of the combined wall sections 215, 230 of FIG. 2 prior to the interaction of the knuckles that form the wall joint 210. As can be clearly seen in FIG. 3, the knuckles of each wall section are complementary to those of the adjoining wall section. The outer panel 310, being slightly larger than the inner panel 320, overlaps the exterior of the knuckles so that upon joining with another wall section, the joint itself is obscured and protected.

Figure 4A:
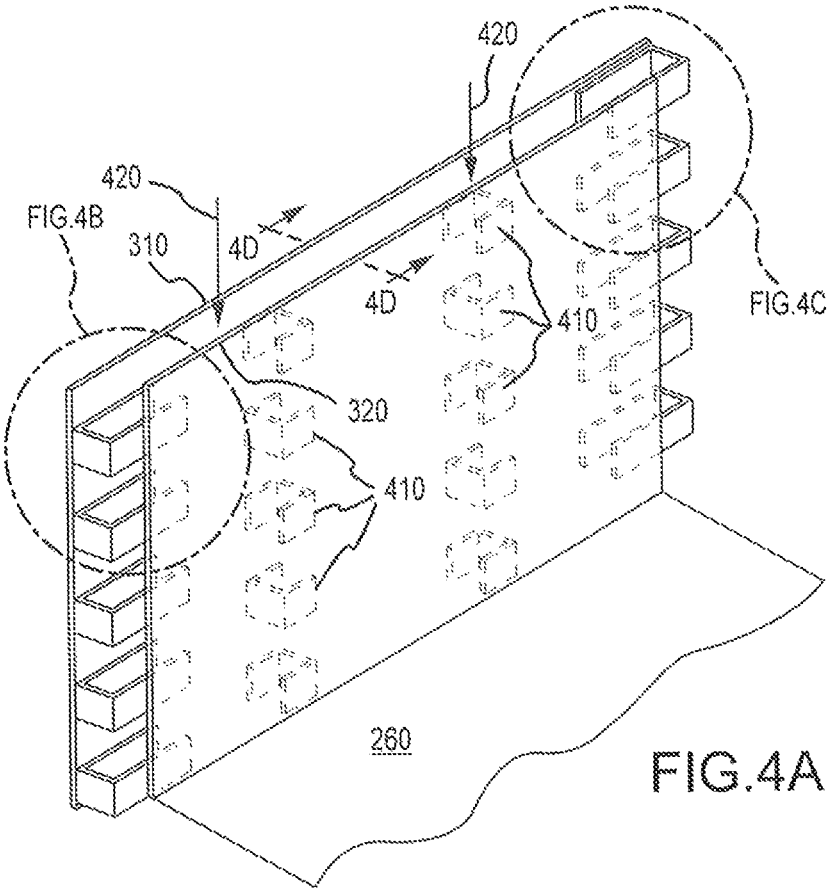
FIG. 4A shows a front perspective view of a wall section according to one embodiment of the present invention.

FIG. 4A shows a wall section according to one embodiment of the present invention. A dual panel design is shown in which the wall section includes an inner panel 320, an outer panel 310, and floor flashing 260. The space or void formed between the inner panel and the outer panel is maintained by the presence of a plurality of channel supports 410. The channels are positioned within the space to create a vertical channel 420. In the depiction shown in FIG. 4A, alternating the channel supports forms two vertical channels 420. In other embodiments of the present invention the distance between the inner panel and the outer panel can be supported by including an orthogonal support in the shape of a cross or 'X'. Each piece of the support enhances the rigidity of the wall section and deters warping.

One aspect of the present invention is to provide a space between the panels that can be filled with a variety of products or materials to enhance insulation, strength, and durability characteristics. For example, once the wall sections are combined and strengthened by adding the vertical dowels, the space between the panels can be filled with insulation, soil, leaves, and other indigenous material that can aid in the shelter's ability to maintain a hospitable internal environment in a variety of weather conditions as well as enhancing the strength and durability of the structure. The weight of the material added to the space between the panels cannot exceed the tensile strength of the adhesive used to secure the inner panel to the outer panel by the support sections. For example, the space can easily be filled with rocks; however, the aggregate weight may drive the panels apart and detrimentally affect the integrity of the walled environment. Similarly, liquid or material containing high moisture content should be avoided as it can compromise the adhesive and structural integrity of the corrugated fiberboard itself.

Figure 4C:
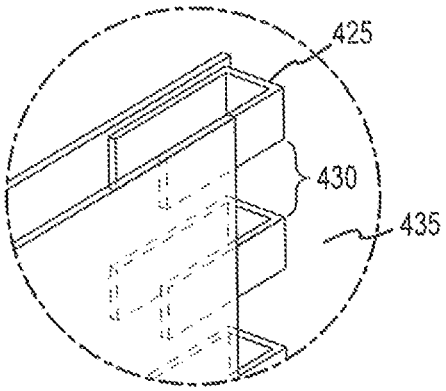
FIG. 4C shows an enhanced view of a set complementary knuckles extending from the other end of the wall section shown in FIG. 4A.
Figure 4B:
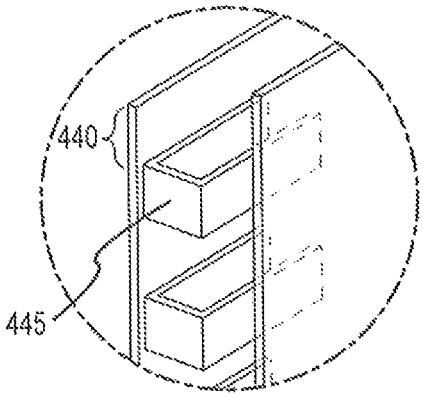
FIG. 4B shows an enhanced view of a set of knuckles extending from one end of the wall section shown in FIG. 4A.

FIG. 4B shows a detailed view of the upper portion of one edge of a wall section according to one embodiment of the present invention. The knuckles shown in FIG. 4B approximate a hollow box structure extending from the edge of the wall. In this depiction, the first knuckle 425 is directly adjacent and flush with the top surface of the wall section and extends downward along the edge approximately 4 inches. The square 4-inch by 4-inch structure provides a hollow region that can accommodate a vertical dowel. Immediately below the first knuckle is a gap 430 void of material. In this embodiment of the present invention, the gap is also approximately 4 inches long. An additional knuckle 435 thereafter follows the gap, which is again approximately 4 square inches. The knuckles and gaps alternate over the entirety of the edge to form one portion of the wall joint. Additionally, the outer panel of the wall section extends to join each of the knuckles and acts as an end cap to gaps between the knuckles. Thus, the gaps are void of material on three of the four sides rather than all four.

Figure 4D:
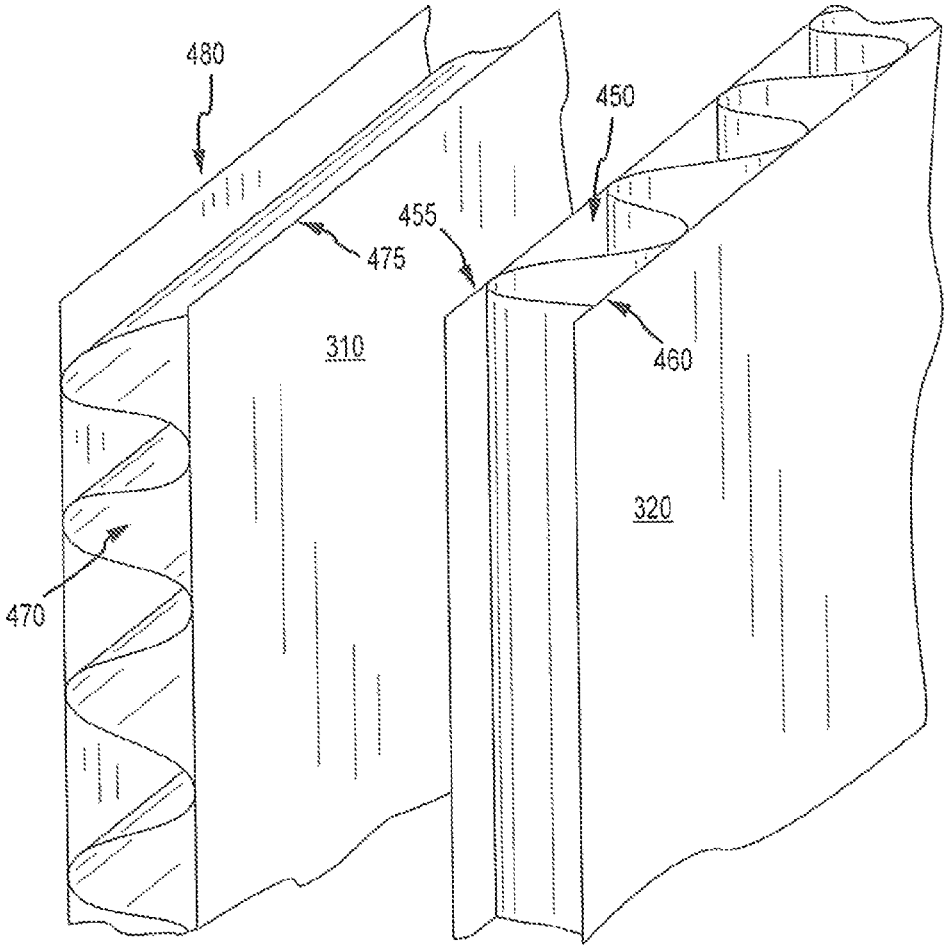
FIG. 4D shows a cross-sectional, cutaway view of the inner panel and outer panel of the wall section shown in FIG. 4A.

FIG. 4C shows a detailed view of the opposite edge of the wall section introduced in FIG. 4A. In each case the wall sections are comprised of corrugated fiberboard that include flutes 450, 470 between the respective sheets of fiberboard. The knuckles shown in FIG. 4C are complementary to the knuckles shown in FIG. 4B. Wherein the wall section edge shown in FIG. 4B depicts a knuckle beginning flush with the top edge of the wall section followed immediately thereafter by a gap, the edge shown in FIG. 4C begins with a gap 440 followed immediately thereafter by a knuckle 445. Accordingly, when two wall sections come together, the first edge of wall section (shown in FIG. 4B) can join with the complementary second edge (shown in FIG. 4C) of the other wall. Once they are interlaced together, knuckles form a single column that is receptive of a dowel (described hereafter) completing the wall joint. And as shown in FIG. 3, the outer panel of each wall section extends beyond the dimensions of the inner panel and coincides with the outer edge of the knuckles. As the wall sections join and the knuckles interlace, the outer panels from each wall section abut each other, thus concealing the joint front the outside environment. Similarly, the inner panels join at the inner corner, again concealing the joint. A folded length of fiberboard can thereafter be affixed over the corner joint to add integrity to the structure and to protect the internal environment. A cross-sectional, cutaway view of the inner and outer panels 320, 310 shown in FIG. 41) illustrates the sandwich nature of the corrugated fiberboard according, to the present invention. The inner 320 and outer 310 panels are each comprised of corrugated fiberboard. Each panel includes an inner sheet of fiberboard 455, 475 and an outer sheet of fiberboard 460, 480. Interposed between each respective inner and outer sheet are flutes which are configured in an accordion or wave fashion to create a space between the inner and outer sheets. In the depiction shown in FIG. 4D the flutes 450 of the inner panel 320 are oriented vertically creating vertical channels. In the outer panel 310 the outer panel flutes 470 are orientated horizontally (perpendicular from the flutes 450 of the inner panel 320).

As one of reasonable skill in the relevant art will appreciate, the shape and size of the knuckles can vary without departing from the innovative means described herein. For example, the knuckles themselves could be circular or oval in shape rather than rectangular. Similarly, the number and orientation of the knuckles can vary. Each of these modifications is contemplated by the present invention.

FIG. 5 shows, according to one embodiment of the present invention, a scored planar sheet of corrugated fiberboard used to form a dowel. A planar sheet 510 of corrugated fiberboard having a length along a longitudinal axis substantially equal to the height of the wall section is scored with a plurality of lines 520. The lines are parallel to the longitudinal axis such that the planar sheet of fiberboard can be rolled into a cylindrical tube. When rolled 530, the tube has a diameter slightly smaller than the internal space found in the interlaced knuckles and the area between the inner and out wall panels. Accordingly, the cylindrical tube of fiberboard forms a dowel that can be inserted into the interlaced knuckles of two wall sections creating a joint. Likewise, a dowel can be inserted vertically into the space between the inner and outer wall panels of a wall section to aid in the wall's rigidity and strength.

Joining a plurality of wall sections forms a walled environment. In one embodiment, and as shown in the exemplary figures, four wall sections can form a rectangular shaped walled environment. In other embodiments, five, six, or more wall sections can be joined together to form various shaped walled environments. As previously mentioned, the integrity, insulation properties, and strength of the walled environment can be enhanced by filling the space between the inner wall panel and outer wall panel of each wall section with material such as insulation, soil, leaves, debris, etc. In one embodiment of the present invention, an inner walled environment is inserted within a circumscribing outer walled environment resulting in multiple panels of corrugated fiberboard wherein each is separated by an air space that can be filled with insulating/supportive material. The resulting walled environment forms a substantial barrier to any surrounding environment and moreover provides ballistic protection from projectiles.

Placing a roof on top of the walled environment forms the temporary structure of the present invention. According to one embodiment of the present invention, the roof is comprised of a plurality of overlapping roof sections constructed from a plurality of corrugated fiberboard roof panels. FIG. 6 shows a perspective view of a single roof section 610 comprised of four joined roof panels. Using trapezoidal shaped roof panels, the roof section forms a tapered band that circumscribes and covers the walled environment.

Figure 7:
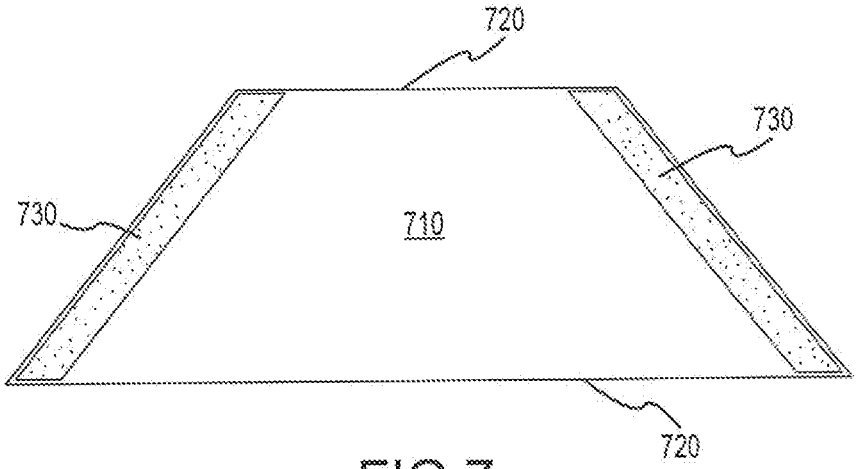
FIG. 7 is a view of an exemplary roof panel according to one embodiment of the present invention.

FIG. 7 is a top view of an exemplary roof panel according to one embodiment of the present invention. The panel is a quadrilateral with one pair of parallel sides 720. In this case, the upper and lower sides are parallel. According to one embodiment of the present invention, the roof panel takes the shape of an isosceles trapezoid. As would be known by one of reasonable skill in the relevant art, an isosceles trapezoid is a convex quadrilateral with a line of symmetry bisecting one pair of opposite sides. As discussed, the upper and lower sides are parallel (albeit of different length), and the two other sides are of equal length. In one embodiment of the present invention, the acute angles of the roof panel are approximately 51 degrees. In other embodiments of the present invention, the acute angle of the isosceles trapezoid is within the range of 45-55 degrees. Each roof panel includes a strip of hook-and-loop fasteners 730, or another suitable means by which to join a roof section to a roof section panel connector.

Figure 8:
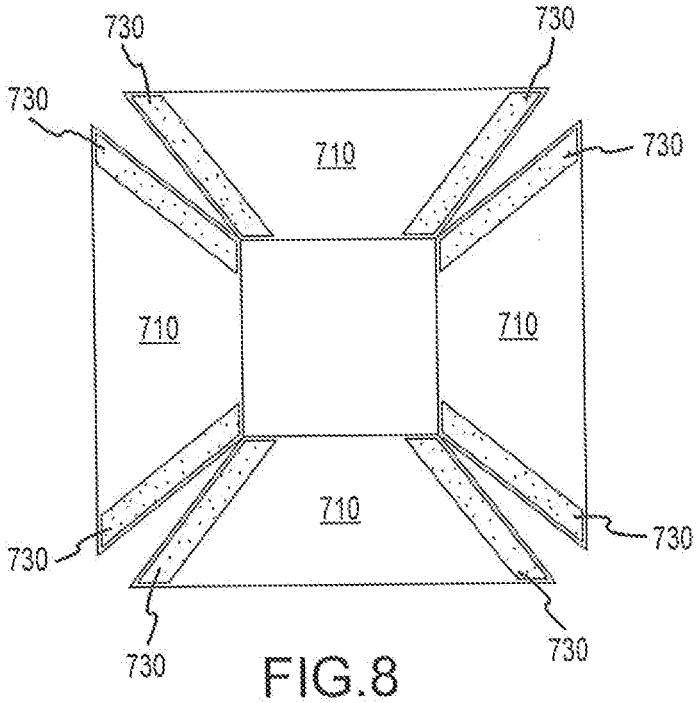
FIG. 8 shows the orientation of a plurality of roof panels so as to form a roof section when joined, according to one embodiment of the present invention.
Figure 9A:
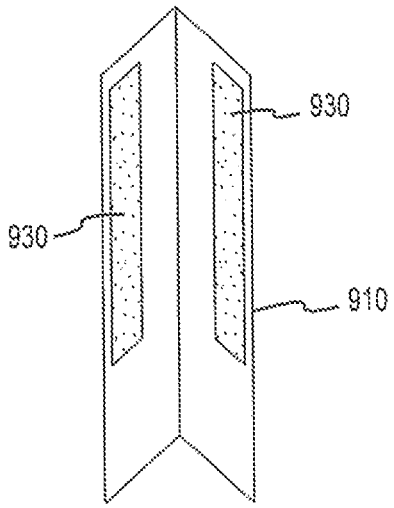
FIGS. 9A and 9B, depict, respectively, an interior view of a roof panel connector, and an exterior view of a roof panel connector, according to one embodiment of the present invention.
Figure 9B:
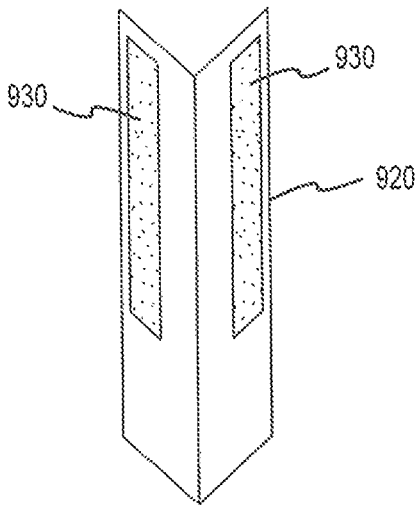

In the embodiment shown in FIG. 6, and as further depicted in FIG. 8, four roof panels are configured to join the smaller parallel edge of each trapezoidal roof panel to form a square. Similarly, a roof formed from five roof panels would join the shorter parallel side to form a pentagon and so forth. The four panels shown in FIG. 8 would join together along the side edges of each trapezoidal panel resulting in the roof section shown in FIG. 6. The panels are joined together using a roof panel connector 910, 920 shown in FIG. 9A and FIG. 9B.

The connector 910, 920 is an angled piece of corrugated fiberboard that includes hook-and-loop surfaces 930 that join with the complementary hook-and-loop 730 surfaces on the interior and the exterior planar sides of each roof panel. According to one embodiment of the present invention, the roof connector is longer than the non-parallel sides of the trapezoidal roof panel. Thus, when two roof panels are joined using the connector, the portion of the connector extending beyond the panel can be used to overlap and join with other roof sections. The connector further creates an intermediate space for ventilation between the roof sections without compromising the integrity of the roof and its ability to connect with the walled environment.

Figure 12:
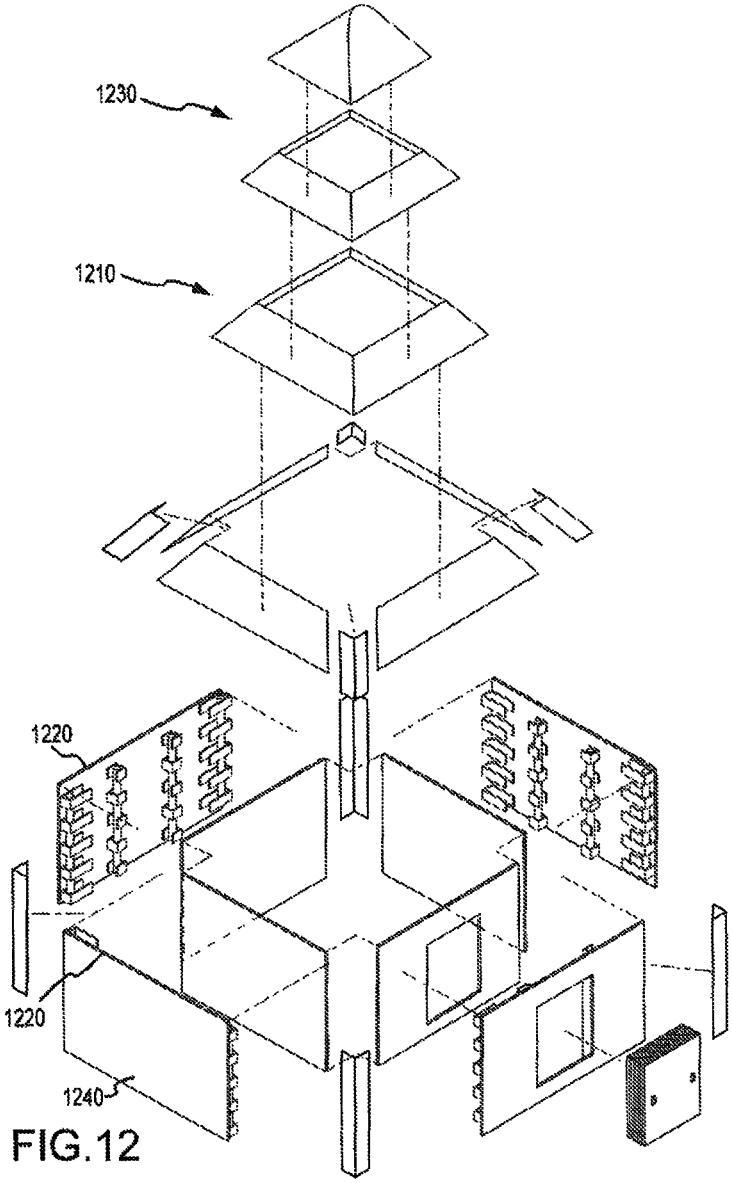
FIG. 12 is an exploded view of one embodiment of a temporary structure according to the present invention showing the position and interaction of the roof sections with the walled environment.

By varying the size of the roof panels, the size of each roof section can be defined. Each roof section is formed using identical roof panels, but different roof sections use different dimensioned roof panels to form different sized roof sections. According to one embodiment of the present invention, positioning three roof sections in an overlapping and concentric formation forms a roof. Using roof panels in which the larger edge of the parallel sides is longer than the length of a single wall section, a bottom or base roof section can be formed. As shown in FIG. 12, the larger or base roof section 1210 can be lowered upon the upper edge 1220 of the walled environment 1240 so that the roof section overlaps and encompasses the wall sections.

The next roof section 1230 can be similarly constructed using roof panels in which the longer parallel side of the trapezoidal panels is longer than the shorter parallel side of the panels associated with the previous (base) roof section. As this roof section is formed and positioned over the walled environment, the larger edges of the upper roof section overlaps with the smaller edge of the lower roof section.

In one embodiment of the present invention, roof panels of three different sizes are used to form three different sized roof sections. By positioning the three roof sections over the walled environment in an overlapping fashion as described above, a roof is created above the walled environment.

As described, each roof section forms a ring or, in this example, a rectangular inclined roof section having a portion in the center that is open. While the opening can be used for ventilation, there are environments in which it would be desirable to have complete coverage of the walled environment.

Figure 10:
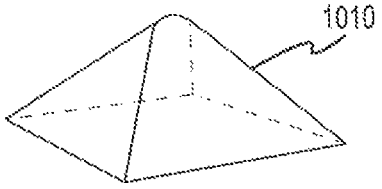
FIG. 10 shows a roof cap according to one embodiment of the present invention.

FIG. 10 depicts one embodiment of a roof cap 1010 constructed from corrugated fiberboard that rests on top of the upper most roof section closing the final opening in the roof. The roof cap is a molded piece of fiberboard that overlaps the space in the uppermost roof section. While in one embodiment, the roof cap is formed from a single piece of corrugated fiberboard, it is also contemplated that the cap can be formed from other material indigenous to the location in which the shelter is constructed. With the cap in place over the uppermost roof section, the entirety of the walled environment is covered.

Another aspect of the roof formed by two or more roof sections is a ventilation space 160 that is formed between each roof section. Recall that each roof panel is joined with other roof panels using internal and external roof panel connectors. Using these connectors, the thickness of the resulting roof sections is larger at each seam or corner. As an upper roof section is towered upon a lower roof section, the roof panel connectors of the upper roof section will make first contact with the roof panel connectors of the lower roof section. The roof panels of the lower and the upper roof section will not physically connect. The gap between the roof sections enables ventilation of the structure and provides natural light to enter the structure.

In one embodiment of the present invention, roof sections are coupled to each other using a fastener or buckle located on the inner lower edge an upper roof section and the upper outer edge of a lower roof section. In one case, two fasteners are equally spaced along each length of roof panel to secure each roof section for being lifted off the walled environment or being displaced by wind or other environmental factors.

As described above, each subsequent roof section is smaller than the roof section immediately below, and accordingly, form a roof. The positioning of the fasteners also enables roof sections to be offset by a 45-degree angle to each other to maximize ventilation and the inclusion of natural light. The fasteners positioned on the upper outer edge of the lower roof section will once again connect with the fasteners found on the lower inner edge of the upper roof section. In this manner, the lighting and ventilation characteristics of the shelter can easily be manipulated.

Figure 11:
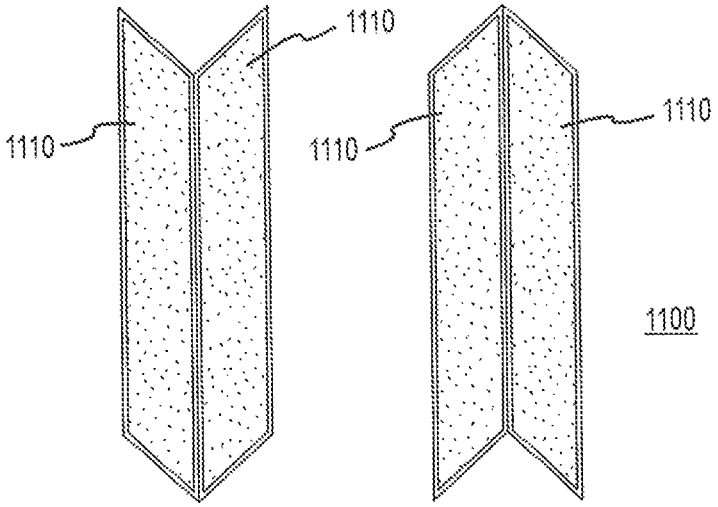
FIG. 11 is a wall corner support structure according to one embodiment of the present invention.

FIG. 11 shows one embodiment of a wall corner support 1100. As discussed herein, each wall section is joined with another wall section by interlacing a plurality of knuckles that are secured by the inclusion of a vertical dowel. The outside panels of each adjacent wall section extend to cover the wall joint, and the interior wall panels mate in the corner to conceal the joint from the interior of the walled environment. To add support and rigidity to the joint, a wall corner support can be affixed to the interior and/or exterior of the structure.

The wall corner support 1100, shown in FIG. 11, is a single folded piece of corrugated fiberboard having hook-and-loop 1100 connectors affixed. Complementary hook-and-loop connectors are placed on the outside edges of each wall panel near each corner and on the inner panels near the interior corner joint. Once the joint is formed as described above, a wall corner support piece is placed over the joint and affixed using, in one embodiment, a hook-and-loop system. In other embodiments of the present invention, the wall corner support can be affixed to the wall joint using adhesive or similar connecting means.

Figure 13:
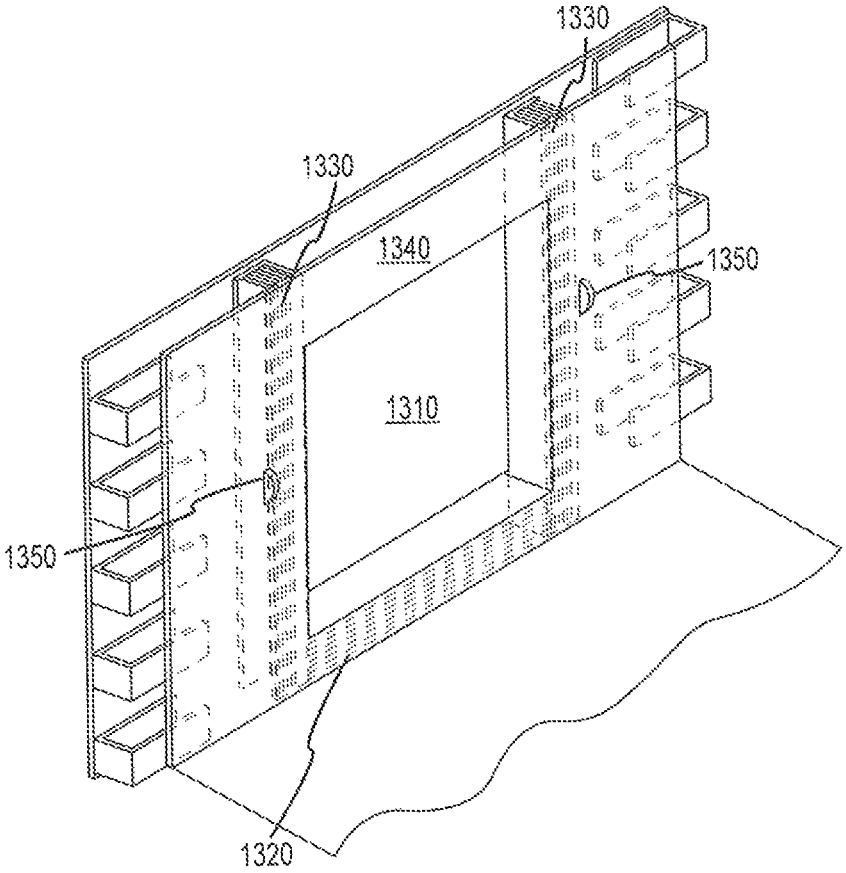
FIG. 13 shows a wall section having an access portal or door opening according to one embodiment of the present invention.

Entry and exit from the temporary shelter of the present invention can be accomplished via a portal or door that is fashioned in one of the wall sections. FIG. 13 shows a wall section with an opening 1310 suitable for entry and exit of the temporary structure. Layers of corrugated fiberboard bind the opening in one embodiment of the present invention. The bottom of the opening, or threshold 1320, comprises a plurality of corrugated fiberboard stacked in a planar fashion. Alternatively, the individual panels of corrugated fiberboard can be orientated vertically and stacked laterally so that the edges of the fiberboard create the threshold. In both instances, the threshold is interposed between the inner and outer panels of the wall section.

The vertical sides 1330 of the opening and the upper cross member are also, in one embodiment, comprised of layers of corrugated fiberboard. While the cross member 1340 may be least robust in nature, it nonetheless provides structural integrity to the wall section. The side portions of the opening are again formed with multiple layers of corrugated fiberboard interposed between the inner and outer panel of the wall section.

Figure 14:
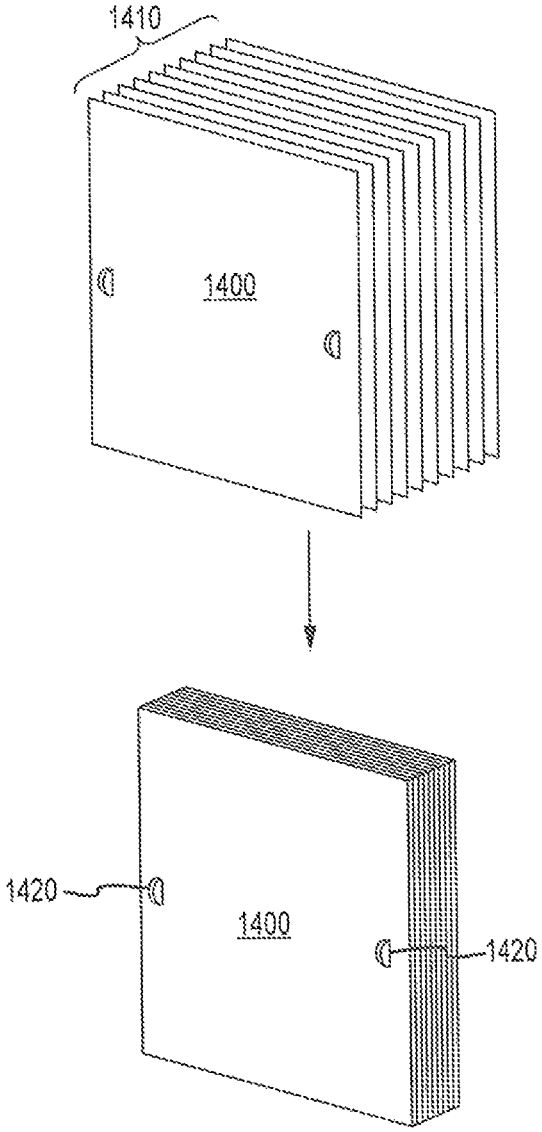
FIG. 14 shows a door compatible with the door opening of FIG. 13 according to one embodiment of the present invention.

The door panel 1400 shown in FIG. 14 occupies the opening of FIG. 13. The door panel is not, in this embodiment of the present invention, affixed or coupled to the wall section. Rather, the door panel uses a friction fit to secure itself within the opening of the wall section and rest upon the threshold. The door panel is, in one embodiment of the present invention, comprised of layers of corrugated fiberboard 1410 affixed together. Each panel of corrugated fiberboard is approximately the same size as the opening in the wall section. A plurality of door panels that, in aggregate, are equal to the width of the wall section are affixed to each other. In one embodiment of the present invention, the panels are joined with each other using an adhesive or similar bonding material. In another embodiment of the present invention, the panels are joined using a constriction device, bolt, or similar fasteners. One skilled in the relevant art will appreciate that multiple means exist by which to join one or more planar sections of fiberboard, all of which are contemplated in the scope of the present invention.

Figure 15:
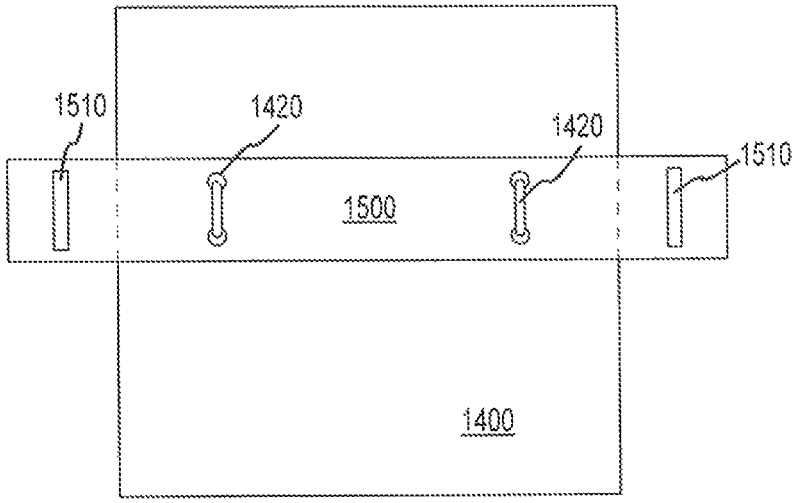
FIG. 15 is a door brace used to secure the door within the door opening according to one embodiment of the present invention.

The door panel, in one embodiment, includes a fastening devise or loop 1420 by which to secure the door panel to the wall section using a door brace 1500. The door brace, shown in FIG. 15, is a rectangular member that spans the opening in the wall section and couples the door panel to the wall section. In one embodiment of the present invention, the door brace, much like the threshold, is comprised of multiple layers of corrugated fiberboard. The layers are joined together using adhesive or similar material to form a rigid member.

In one embodiment, the door brace includes a set of openings 1510 that traverse the brace. The openings are positioned to accept locking rings 1350 extending from the vertical supports of the wall section. In one embodiment, these rings 1350 are secured in the vertical sides of the door opening and extend outward beyond the outer wall panel. The loops extend sufficiently so that the openings in the door brace can accept the loops and then protrude beyond the exterior surface of the braced. The door brace can then be secured into position using a lock or similar means.

The door brace also includes a means by which to secure itself to the door panel. In one embodiment of the present invention, the door brace is affixed to the exterior of the door panel, using, for example, an adhesive. In other embodiments, the door brace is coupled to the door panel using a "U" bolt or similar attachment mechanism.

With the door brace affixed or connected to the door panel, the door panel can be placed within the door opening and secured to the wall section. As the door panel is not hinged or similarly linked to the wall section, the pane can be affixed to the wall section from either the interior or exterior of the structure.

The means by which the door brace can be connected to the wall section are known within the art. The specifics of their application within the context of the present invention will be readily apparent to one of ordinary skill in the relevant art in light of this specification.

Figure 16:
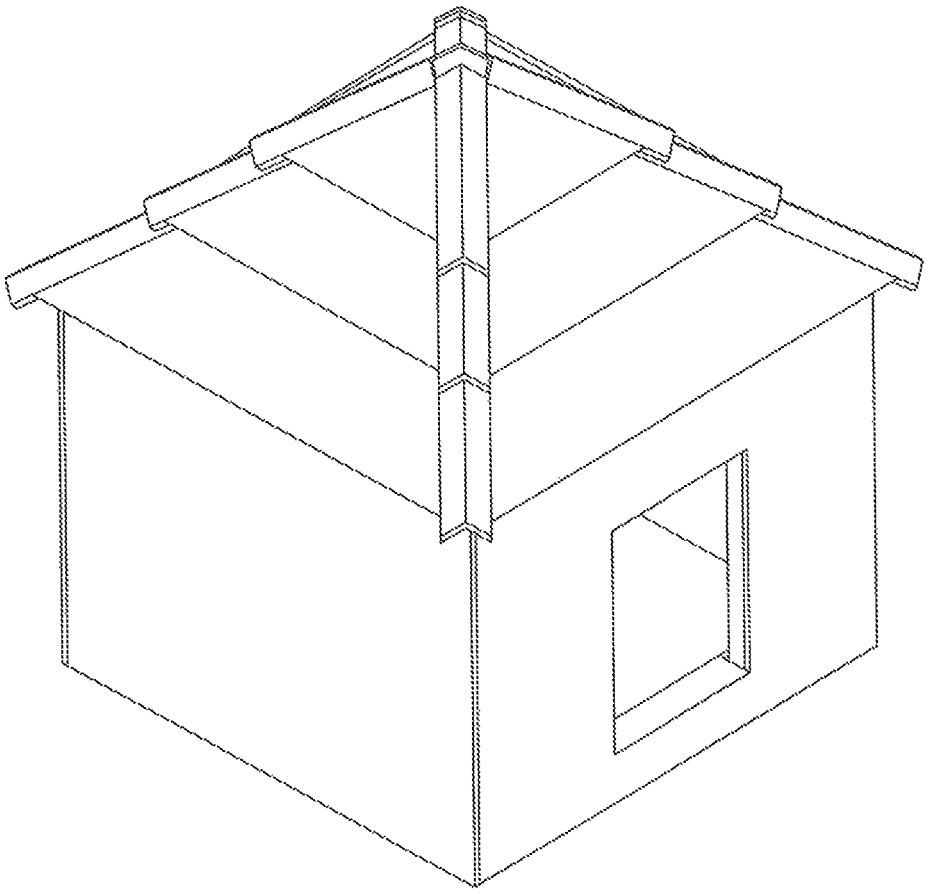
FIG. 16 is a perspective view of a completed temporary structure according to one embodiment of the present invention.
Figure 17:
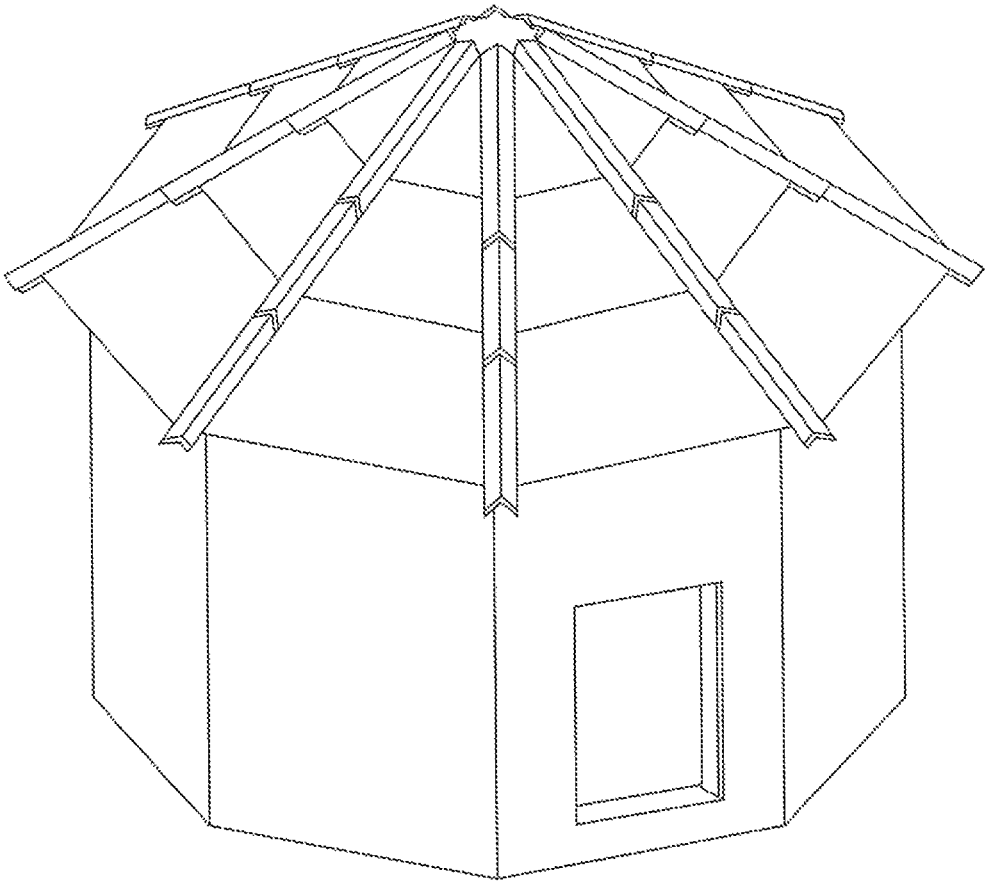
FIG. 17 is a perspective view of another embodiment of the present invention wherein an octagon shape is formed from connected walled sections; and, FIG. 18 is a flowchart of one method embodiment for constructing a temporary structure using corrugated fiberboard.

FIG. 16 presents a perspective view of a four-sided temporary shelter 1600 according to the concepts and innovative teachings presented above. The temporary structure of the present invention can be easily transported, stored in an unassembled fashion, and then quickly erected should an emergency event occur. While the temporary structure described herein and as shown in FIG. 16 has been disclosed as comprising four wall sections to form a rectangular structure, one of reasonable skill in the relevant art will appreciate that the design of the present invention can accommodate a variety of different shapes and sizes. For example, FIG. 17 presents a temporary structure 1700 consistent with the teachings of the present invention forming a octagon shape. Thus, the depictions presented here are exemplary in nature and should not be viewed as constraining the concepts to a particular shape, orientation, or mode of construction.

While in a preferred embodiment of the present invention, the temporary structure is primarily constructed from corrugated fiberboard, other material can be utilized to form the temporary structure of the present invention. Material that can be fashioned and joined in similar manner as described herein can also be utilized such as foam boards, synthetic material, plastics, and the like. And while the invention has been particularly shown and described with reference to embodiments shown above, it will be understood by those skilled in the art that various other changes in the form and details may be made without departing from the spirit and scope of the invention.

Figure 18:
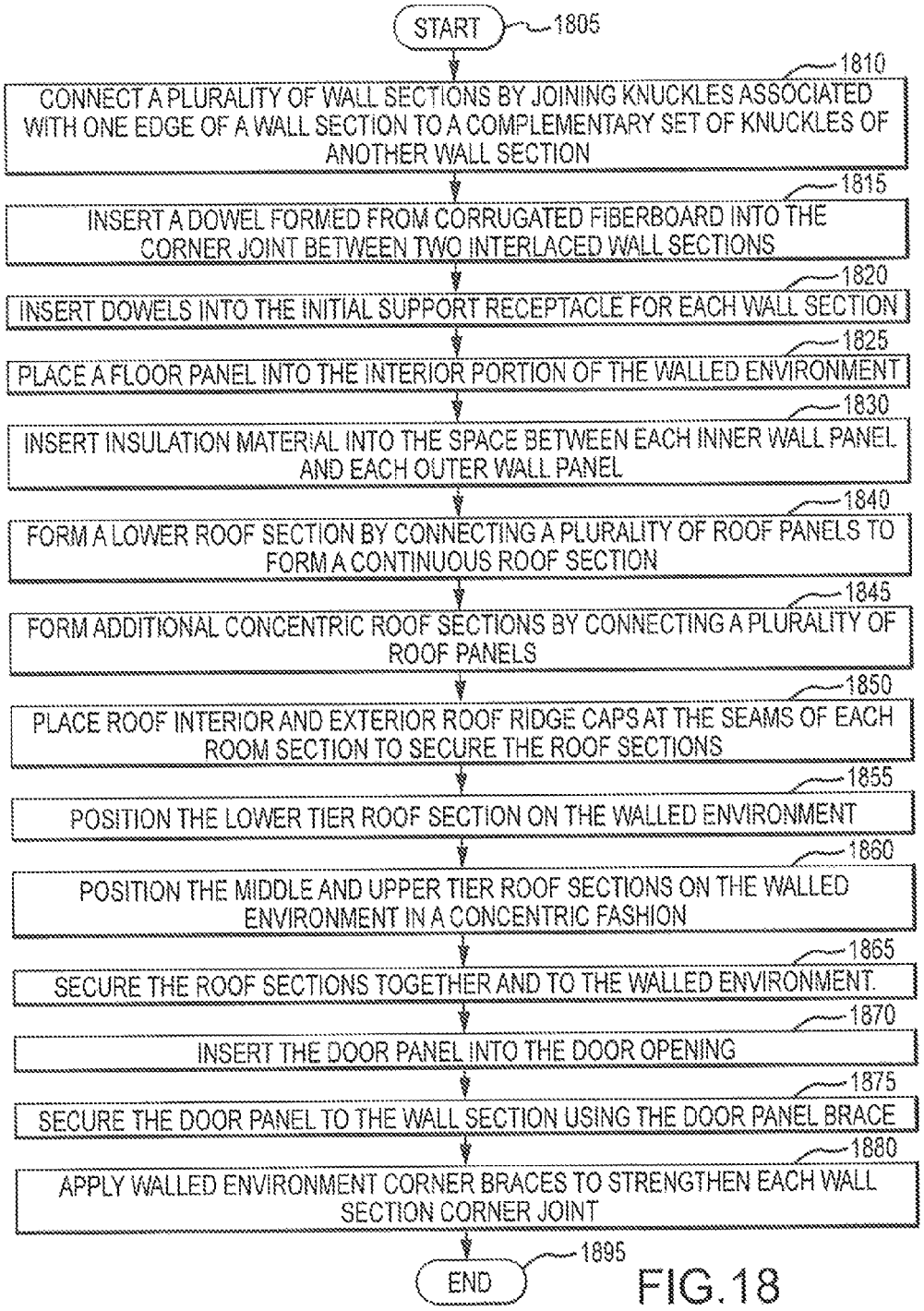

FIG. 18 provides a high level methodology for assembly of a temporary structure substantially comprised of corrugated fiberboard. The process begins 1805 by connecting 1810 a plurality of wall sections together to form a walled environment. As previously described each wall section includes a series of extensions or knuckles that mate with a complementary set of knuckles from a joining wall section. As the knuckles interlace to form a joint a dowel is inserted 1815 into the joint to secure the wall sections together. In one embodiment of the present invention the dowel is formed from a planar piece of corrugated fiberboard that is scored on one side. The scoring enables the planar piece of corrugated fiberboard to be rolled into a cylinder equal to approximately the height of the wall section.

The interlaced knuckles create a vertical column into which a dowel is placed to secure the two wall sections together. The vertical rigidity of the wall section is thereafter enhanced by the insertion 1820 of similarly rolled corrugated fiberboard dowels in to support receptacles. Recall that each wall section is comprised of a wall space interposed between two planar sheets of corrugated fiberboard. The space between the planar sheets is defined by the wall joint components (knuckles) on either end of the wall section. Within the interior of the wall section, internal support structures, similar to the knuckles or a 'C' channel, are positioned to create two or more vertical columns/receptacles. These receptacles can receive a dowel to enhance the strength and integrity of the wall section.

In a similar manner other wall sections can be joined together until a walled environment is created. Each wall section includes a flashing that extends into the interior of the walled environment by approximately 6-24 inches. Inserting a floor section 1825 can cover the interior portion of the walled environment. The floor section is, in one embodiment of the present invention, comprised of one or more planar sheets of corrugated fiberboard. The floor section overlaps, and, in one embodiment can be secured to the flashing associated with each wall section. By securing the planar floor section to the flashing's of each wall section the walled environment gains substantial lateral strength and the ability to accommodate shear flow.

With the walled environment formed, insulation or other material that can aid in support of temporary shelter can be inserted 1830 into the wall space found between the inner and outer panel of each wall section. In other embodiments of the present invention, ballistic fabric or ballistic sheets of armor can be inserted into the wall space to create a barrier from any sort of fragmentation or similar projectiles.

The roof is comprised of two or more roof sections that circumscribe and overlay the erected walled environment. Each roof section is formed 1840 by connecting a plurality of roof panels into a continuous/contiguous shape. In one embodiment of the present invention each roof panel of a particular roof section are isosceles trapezoids that are joined on the non-parallel sides. The result, in this case, are a rectangular convex roof sections 1845 that overlap and rest on the upper edge of the walled environment.

Placing interior and exterior roof ridge caps 1850 at the seams of each roof panel forms the roof sections. The roof ridge caps extend beyond the length of the roof panels to aid in placement on top of the walled environment as well as other roof sections. In another embodiment, the roof section tiers can be one solid piece.

The completed roof sections are lowered 1855 on top of the walled environment in a successive manner. Each roof covers an increasing amount of the interior space of the walled environment and yet overlaps the roof section (or wall sections) below. As the successive tiers of roof section are positioned on the structure in a concentric fashion they are secured 1865 to each other and to the walled environment below 1860.

At least one of the wall sections includes an opening that can be used for entry and exit to the temporary structure. To control access to the temporary structure a door panel is inserted 1870 into the door opening. The door panel is secured 1875 using a door panel brace. According to one embodiment of the present invention the door panel resets on the threshold of the door opening and is held in place by friction. The brace is connected to the door panel, in one embodiment, using a series of bolts, washers and nuts. Since the door panel is not permanently connected to the wall section the door brace can be positioned on the interior of the structure to secure the door from within or on the exterior of the structure to secure the door panel upon existing the structure. In either case the door brace is secured to the wall section using, in one embodiment, a "U" bolt what extends from the wall section and through the door brace.

Lastly, corner braces 1880 can be optionally attached to each corner of the wall sections to further support and secure the wall joints. The corner braces not only assists in strengthening the wall joint but also protects the knuckles and dowel from environmental factors. With the braces in place the temporary shelter is constructed 1895.

The temporary shelter of the present invention is easily transported and erected. The entire structure can be transported as a kit of planar pieces of corrugated fiberboard and constructed on site. No tools are required to assemble the shelter. The shelter, once constructed, can withstand the harshest of environments and is durable enough to last several months. Indeed testing indicates that a shelter that can be constructed in less than an hour can last up to two years in almost all environments. The material used to construct the temporary structure of the present invention is, in a preferred embodiment, corrugated fiberboard. While other materials are usable and contemplated by the inventor, treated corrugated fiberboard provides a cost effective and durable solution to the problem of quickly creating a durable and habitable temporary structure.

Upon reading this disclosure, those of skill in the art will appreciate still additional alternative structural and functional designs for the temporary structure through the disclosed principles herein. Thus, while particular embodiments and applications have been illustrated and described, it is to be understood that the disclosed embodiments are not limited to the precise construction and components disclosed herein. Various modifications, changes, and variations, which will be apparent to those skilled in the art, may be made in the arrangement, operation, and details of the method and apparatus disclosed herein without departing from the spirit and scope defined in the appended claims.

I claim:

1. A portable shelter configured for use as a temporary shelter, the portable shelter comprising:

a plurality of planar wall sections configured to form an enclosure constructed from corrugated fiberboard material wherein each planar wall section includes an inner panel, an outer panel, and a fillable region interposed between the inner panel and the other panel, and wherein each planer wall section includes a top edge, a bottom edge, a first side edge, and a second side edge wherein the first side edge includes a set of extensions and the second side edge includes a set of complementary extensions so that the set of extensions on the first side edge is configured to receive the complementary set of extensions from another wall section forming a wall joint;

a plurality of linking corrugated fiberboard panels wherein each linking corrugated fiberboard panel includes a plurality of parallel scores such that each linking corrugated fiberboard panel can be rolled to form a dowel and wherein, each wall joint is configured to accept one of the dowels linking the set of extensions to the complementary set of extensions; and, one or more roof sections positioned on the enclosure to create a roof forming the temporary shelter.

2. The portable shelter of claim 1, wherein each roof section is formed from, a plurality of trapezoidal roof panels constructed from corrugated fiberboard material wherein non-parallel sides of the plurality of trapezoidal roof panels are joined forming a seam to create the roof section.

3. The portable shelter of claim 1, wherein each extension is a 'C' channel coupling the inner panel to the outer panel.

4. The portable shelter of claim 1, wherein the inner panel is constructed from corrugated fiberboard and includes a set of inner panel flutes and wherein the outer panel is constructed from corrugated fiberboard and includes a set of outer panel flutes and wherein the inner panel flutes and the outer panel flutes are oriented so as to be perpendicular to each other.

5. The portable shelter of claim 1, wherein each planar wall section includes two or more internal support channels, each configured to accept one of the dowels.

6. The portable shelter of claim 1, further comprising a joint cap affixed to an exterior portion of each wall section forming the joint wherein the joint cap bridges the joint.

7. The portable shelter of claim 1, wherein the roof is comprised of a plurality of roof sections.

8. The portable shelter of claim 1, wherein a ventilation space is created between each roof section.

9. The portable shelter of claim 1, further comprising a roof peak cap.

10. The portable shelter of claim 1, wherein each of the one or more roof sections overlap such that a longer side of each trapezoidal roof panel of an upper roof section is associated with a shorter side of each trapezoidal roof panel of a lower roof section.

11. The portable shelter of claim 1, further comprising a plurality of roof ridge caps affixed to an exterior portion of each trapezoidal roof panel covering the seam.

12. The portable shelter of claim 1, wherein at least one of the plurality of wall sections includes an aperture suitable to enable ingress and egress to the temporary shelter.

13. The portable shelter of claim 12, further comprising a door configured to fit within the aperture.

14. The portable shelter of claim 13, wherein the door includes a securing mechanism configured to secure the door to the wall section from either within or outside the temporary shelter.

15. A corrugated fiberboard temporary shelter, comprising:

an enclosure formed from coupling together a plurality of wall sections wherein each planar wall section includes a fillable region interposed between an inner panel and an outer panel constructed from corrugated fiberboard material wherein each planer wall section includes a top edge, a bottom edge, a first side edge, and a second side edge;

a plurality of wall section joints wherein each wall section joint includes a set of knuckles associated with the first side edge of a wall section and a set of complementary knuckles associated with a second side edge of another wall section and wherein the set of knuckles associated with the first side edge is configured to receive the set of complementary knuckles associated with the second side edge of the other wall section forming a barrel;

a dowel inserted into the barrel of each wall section joint coupling together the plurality of wall sections to form the enclosure; and, a roof covering the enclosure whereby the roof is formed by positioning two or more roof sections on top of the enclosure by overlapping each of the roof sections such that a longer side of an upper trapezoidal roof panel of an upper roof section is associated with a shorter side of a lower trapezoidal roof panel of a lower roof section.

16. The corrugated fiberboard temporary shelter of claim 15, wherein each roof section is constructed from a plurality of similarly sized corrugated fiberboard trapezoidal roof panels by joining non-parallel sides of the roof panels and wherein each of the roof sections is formed from corrugated fiberboard trapezoidal roof panels of different sizes.

17. The corrugated fiberboard temporary shelter of claim 15 wherein the corrugated fiberboard material includes flutes, and wherein flutes associated with the inner panel are perpendicular to flutes associated with the outer panel.

18. The corrugated fiberboard temporary shelter of claim 15, wherein the dowel is comprised of a panel of corrugated fiberboard rolled to form a cylindrical shape compatible with the barrel.

19. The corrugated fiberboard temporary shelter of claim 15, wherein each wall section includes a plurality of channels parallel with the well section joints within the fillable region, and wherein each channel is configured to accept a dowel to increase wall section strength and rigidity.

20. The corrugated fiberboard temporary shelter of claim 15, wherein the roof includes a roof cap.

21. The corrugated fiberboard temporary shelter of claim 15, wherein each wall section includes a floor flashing.

22. The corrugated fiberboard temporary shelter of claim 21, further comprising a floor inserted into the enclosure and overlapping the floor flashing.

* * * * *